United States Patent [19]

Musall et al.

[11] 3,945,803

[45] Mar. 23, 1976

[54] ELASTIC SUPPORT FOR A CERAMIC MONOLITHIC CATALYZER BODY

[75] Inventors: Reimar Musall; Wilhelm Wolsing; Klaus Almeroth, all of Hannover, Germany

[73] Assignee: Kali-Chemie AG, Hannover, Germany

[22] Filed: Apr. 3, 1973

[21] Appl. No.: 347,559

[30] Foreign Application Priority Data

Apr. 7, 1972 Germany ..... 2216772

[52] U.S. Cl. ..... 23/288 FC; 138/108; 138/112

[51] Int. Cl.[2] ..... B01J 8/00; F01N 3/15

[58] Field of Search ..... 23/288 F, 288 FC; 60/299; 138/37, 108, 112

[56] References Cited

UNITED STATES PATENTS

| | | | |
|---|---|---|---|
| 2,506,293 | 5/1950 | Copeland | 285/299 X |
| 2,850,365 | 9/1958 | Adey et al. | 23/288 FC UX |
| 2,850,368 | 9/1958 | Adey | 23/288 FC UX |
| 3,094,394 | 6/1963 | Innes et al. | 23/288 F |
| 3,197,287 | 7/1965 | Innes et al. | 23/288 F |
| 3,211,534 | 10/1965 | Ridgway | 23/288 F X |
| 3,248,188 | 4/1966 | Chute | 23/288 F UX |
| 3,441,381 | 4/1969 | Keith et al. | 23/288 F |
| 3,441,382 | 4/1969 | Keith et al. | 23/288 F |
| 3,597,165 | 8/1971 | Keith et al. | 23/288 F |
| 3,692,497 | 9/1972 | Keith et al. | 23/288 F |
| 3,719,457 | 3/1973 | Nagamatsu | 23/288 F |
| 3,785,781 | 1/1974 | Hervert et al. | 23/288 F |
| 3,798,006 | 3/1974 | Balluff | 23/288 F |
| 3,801,289 | 4/1974 | Wiley | 23/288 FC |
| 3,841,842 | 10/1974 | Wiley | 23/288 FC |

FOREIGN PATENTS OR APPLICATIONS

| | | | |
|---|---|---|---|
| 791,117 | 7/1968 | Canada | 23/288 FC |

*Primary Examiner*—Barry S. Richman
*Attorney, Agent, or Firm*—Ernest F. Marmorek

[57] ABSTRACT

In an apparatus for cleaning exhaust gases comprising a rigid housing forming an outer wall of the exhaust conduit, a pocket formed at each end of the housing, a pair of accordion-shaped or corrugated wall and resilient compensating devices placed at each end into the pockets and each having gripping end portions, a catalyzer body of the monolithic type being placed between the gripping end portions for suspension axially within the housing with a gap in the housing.

8 Claims, 4 Drawing Figures

ELASTIC SUPPORT FOR A CERAMIC MONOLITHIC CATALYZER BODY

CROSS-REFERENCE TO OTHER APPLICATIONS

Ser. No 349,477, filed Apr. 9, 1973, by Musall et al.

FIELD OF THE INVENTION

The present invention relates to an elastic suspension for ceramic monolithic bodies, and more particularly it relates to the suspension of such monolithic bodies which are used as catalyzer carriers preferably in devices for the decontamination of exhaust gases of automobiles.

BACKGROUND OF THE INVENTION

The use of ceramic catalyzer carriers having a honeycomb structure for the cleaning of exhaust gases, especially for the cleaning of the exhaust gases of automobiles, has been already known. Such honeycomb structures combine two advantages. On one hand they possess a large surface with respect to a unit volume, on the other the flow resistance through them is very small. The difficulty of their use in devices for the decontamination of exhaust gases of automobiles resides in their required elastic suspension. The pushing forces and vibrations which occur during the travelling of the car, place a heavy mechanical requirement on the honeycomb structure so that finally this will lead to a destruction of the catalyzer carrier.

Elastic suspension for such honeycomb structures have been already proposed, such as by U.S. Pat. No. 3,441,382, which describes a catalyzer patron which exists from a ceramic monolithic catalyzer element placed in a metallic housing and in which, between the catalyzer and the housing wall, a heat insulating mass, such as fire resistant brick, or molten aluminum oxide, etc., is placed. By means of a metallic spring, which can be adjusted, a pressure is applied to the insulating mass so that the catalyzer body is retained fixedly in its position. Such suspension turned out to be, however, not sufficiently elastic. The pressure applied to the body of the catalyzer is too large and is not uniformly distributed in order to be able to prevent an eventual mechanical destruction of the honeycomb structure.

Another device for the catalytic decontamination of the exhaust gases of automobiles has been described in German DAS 1,476,507. In such a device the monolithic catalyzer is placed in a cylindrical housing between a pair of annular flanges which are in gas-tight connection with the housing. Into the annular gap between the housing and the catalyzer a resilient wavy member is placed which can be in form of a corrugated or wavy wire mesh which surrounds the catalyzer body very tightly.

The experience of the automobile industry, especially in the case of high revolution four-cycle engines, proves that the wavy-shaped wire mesh inserts cannot withstand the high thermal and mechanical loading even when the wire mesh is made from a high heat-resistant steel. The ceramic body which is embedded in the wire mesh begins to wander around within it when the spanning effect of the wire mesh has lost its original tight application. Then due to the subsequent large shaking and oscillating forces the ceramic body will become quickly destroyed.

SUMMARY OF THE INVENTION

It is therefore an object of the present invention to provide an improved elastic suspension for a ceramic body of the monolithic type preferably used as a catalyzer carrier in an exhaust gas cleaning arrangement for automobiles which is capable to withstand the severe shocks and oscillating forces arising during the travelling of the vehicle.

The invention will become more readily apparent from the following description of preferred embodiments thereof shown in the accompanying drawings, in which:

DESCRIPTION OF THE PREFERRED EMBODIMENT

Figure 1:
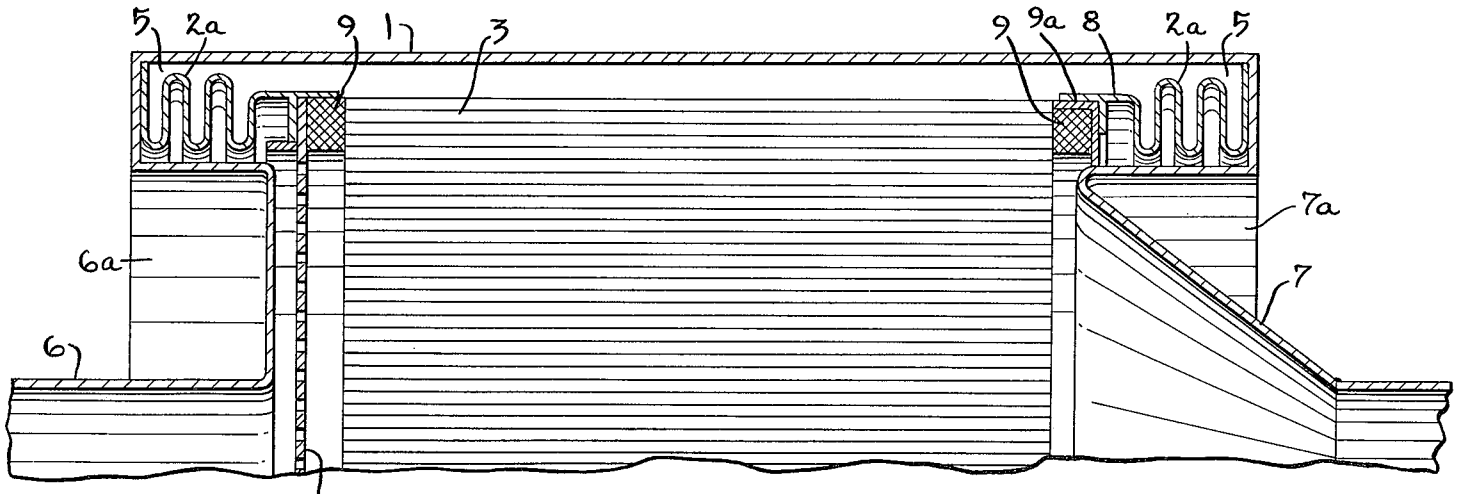
FIG. 1 is a longitudinal cross-section of the housing containing the catalyzer body and its elastic suspension according to the present invention.
Figure 2:
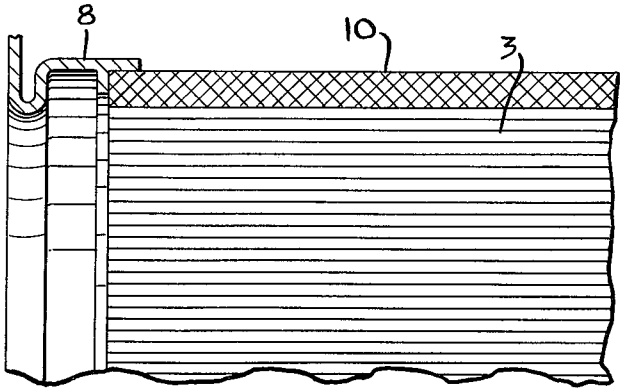
FIG. 2 is a longitudinal cross-section through the honeycomb structure having an outer sleeve and an elastic suspension.

The apparatus including the inventive suspension for the catalyzer body within an exhaust gas cleaning arrangement as it can be seen in FIG. 1 includes a metallic housing 1 which is rigid and is closed at other portions than at the two ends thereof for the entry and exit of the exhaust gases thereto, and wherein in FIG. 1 the suspension means is in the form of the soft wave-shaped or resilient corrugated walled compensating arrangement **2*a* made from a heat-resistant material and which are placed in pocket means 5 formed before the end portions of the cylindrical housing 1. The cylindrical housing 1 at the same time forms the outer wall of an exhaust gas conduit of the exhaust gas cleaning arrangement itself. A ceramic monolithic body 3 having a honeycomb structure is placed within the housing and is axially suspended between the accordion-shaped compensator means 2*a* at both ends thereof. As mentioned above, the accordion-shaped compensators 2*a* are placed in an annular shaped pocket means 5 at each end of the housing 1 which at one side has a wall portion formed either as a conically shaped connecting wall 7 connecting the housing 1 with the exhaust conduit, or it has a straight wall portion 6 similarly connecting the housing 1 with the exhaust conduit and further with the exhaust gas system of the vehicle. The pockets 5 will not be passed through by the exhaust gas since the compensating means 2*a* in addition to being the elastic suspension means for the catalyzer body 3 serve also as a gas-tight seal within the system. The wide spaces 6*a* and 7*a* at each end of the housing are filled by an insulating material and, as a result, the compensating means 2*a* even during the operation remain relatively cold so that they will not lose their resiliant properties. The honeycomb structure 3 is either directly suspended between the gripping means 8 integrally formed with the compensating means 2*a* or they are supported in ceramic rings 9, or in addition in a ceramic sleeve 10 as can be seen in FIG. 2**, so that the gripping means 8 can abut against the rings 9 or against the sleeve 10 with a certain bias. In order to obtain a good sealing between the rings 9 or the sleeve 10 in the case of the embodiment illustrated in FIG. 2, and between the gripping means 8, a ceramic wool material 9a can be placed there between as illustrated in FIG. 1 only. In order to attain an improved gas distribution, one may provide a perforated plate 11 consisting of a heat resistant steel or a ceramic material and placed between the compensating means 2a and the ceramic body 3 at least at one end which is exposed to the incoming hotter gases.

As mentioned above, the compensators 2a are given a certain initial tensioning or bias so that the different heat expansions can be fully compensated and the high accelerating forces in the radial and axial directions can be also reduced or countered without causing the developing of gaps during the application of such forces between the ceramic body 3 and the compensating means 2a.

Figure 3:
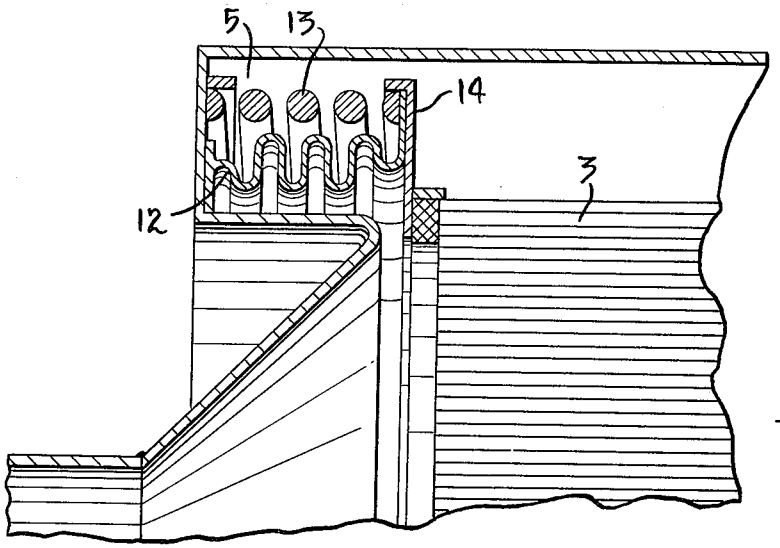
FIG. 3 is a longitudinal section partially through the apparatus according to the present invention having an alternative elastic suspension of the ceramic catalyzer body.

A further embodiment of the elastic suspension means according to the present invention is illustrated in FIG. 3. Here the eventual sealing of the gas is achieved by an especially soft accordion-shaped or corrugated walled compensating means 12 which with one foot portion thereof abuts against the bottom of the pocket means 5 formed similarly as described in connection with FIG. 1 and with the other end thereof it abuts against the ceramic body 3 itself or against a loosely mounted intermediate flange 14, or it is fixedly connected with the loosely mounted intermediate flange 14. The mechanical resilient suspension of the ceramic body is obtained by use of a coil spring 13 which at one end thereof abuts against the bottom of the pocket means 5 while at the other end thereof abuts against the flange 14 and at both ends clamping down and thereby providing the required resiliency to the resilient means 12.

Figure 4:
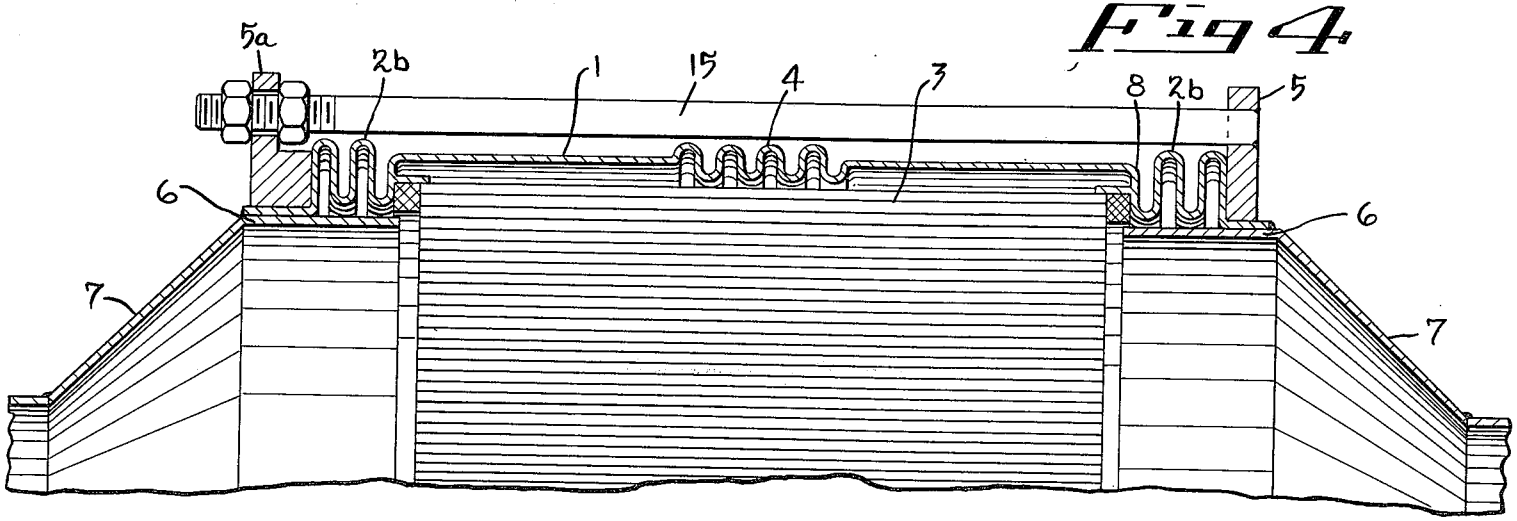
FIG. 4 is a longitudinal section through an alternative embodiment of the present invention.

In the embodiment according to FIG. 4 the compensating means 2b are placed not in the closed chamber, but in a portion of the outer wall of the housing 1. The compensating means 4 is a part of the outer wall of the housing 1. In this case the compensating means has a somewhat harder elastic relationship with the ceramic body 3 than it is the case with the compensating means 2a of the other embodiment. The compensating means 4 before the ceramic body 3 placed therebetween is given such strong initial spring bias that the gripping means 8 cannot liftoff or separate from the ceramic body 3 during operation or heat expansion or due to the mechanically loading of the entire device during the running of the vehicle. They are provided with cylindrical stops 6 and connected with flanges 5 and 5a fixed in a manner such as by being welded thereto. The flanges 5 and 5a are securely connected with each other by three or more bolts 15.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. An apparatus for cleaning exhaust gases comprising a monolithic catalyst body suitable for removing toxic gases from a gas flow through an exhaust gas passage and an elastic holder resiliently supporting said monolithic catalyst body, said elastic holder including a rigid metallic housing having an inlet opening and an outlet opening and forming an outer wall of said exhaust gas passage;

resilient means operable to apply a resilient force upon being compressed, disposed within said housing and a major portion of which is spaced from said housing near each opening therein and being compressed, said resilient means comprising a corrugated wall device, the space between said resilent means and said housing forming an annular chamber near each opening in said housing;

inner circumferential plate means secured to said housing and dispoded therein for guiding and supporting said resilient means for axial movement thereof said plate means being disposed between said resilient means and said gas flow to thereby shield said resilient means from direct contact by the gases;

gripping end portions operably secured to and axially pressed by said compressed resilient means, said gripping end portions being positioned to suspend the monolithic catalyst body therebetween whereby the monolithic catalyst body is resiliently suspended, within said housing, between said gripping end portions.

2. The apparatus as claimed in claim 1, wherein a perforated plate means is placed between said gripping end portions and the catalyst body, said plate means extending substantially over the entire cross-section of said catalyst body.

3. The apparatus as claimed in claim 1, wherein said resilient means is an especially soft flexible corrugated walled device means, a compression spring placed in each said annular chamber, each said gripping end portion comprising a flange for supporting said catalyst body, said spring abutting at one end thereof against a wall portion of said annular chamber and at the other end thereof against said flange and thereby, in combination with the corrugated walled device resiliently supporting said catalyst body in said housing while simultaneously clamping said flexible corrugated walled device at respective ends thereof against said flange and said wall portion of said annular chamber.

4. An apparatus, as claimed in claim 1, and further including an intermediate resilient means operable to apply a force as a result of its resilient return to original size after having been stretched, intermediate and operably secured to said gripping end portions whereby said gripping end portions are resiliently pulled in a direction toward each other.

5. The apparatus as claimed in claim 1, wherein a ceramic ring means is inserted between said catalyst body and said gripping end portions of said resilient means.

6. The apparatus as claimed in claim 5, wherein a heat-resistant sealing material is placed between said gripping end portions and said ceramic ring means.

7. The apparatus as claimed in claim 1, wherein a ceramic sleeve means is placed about said catalyst body, said sleeve means cooperating at the end portions thereof with said gripping end portions of said resilient means for supporting said catalyst in said axial direction.

8. The apparatus as claimed in claim 7, wherein a heat-resistant material is placed between said gripping end portions and said sleeve means.

* * * * *